US008863351B2

(12) United States Patent
Mayer

(10) Patent No.: US 8,863,351 B2
(45) **Date of Patent: *Oct. 21, 2014**

(54) FLOOR CLEANING MACHINE

(71) Applicant: Diversey, Inc., Sturtevant, WI (US)

(72) Inventor: Heinrich-Tito Mayer, Eschlikon (CH)

(73) Assignee: Diversey, Inc., Sturtevant, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/030,152

(22) Filed: Sep. 18, 2013

(65) Prior Publication Data

US 2014/0013524 A1 Jan. 16, 2014

Related U.S. Application Data

(63) Continuation of application No. 13/477,846, filed on May 22, 2012, now Pat. No. 8,561,256, which is a continuation of application No. 11/569,642, filed as application No. PCT/US2005/015192 on May 3, 2005, now Pat. No. 8,234,748.

(30) Foreign Application Priority Data

May 26, 2004 (EP) ..... 04012451

(51) Int. Cl.

| | |
|---|---|
| ***A47L 11/00*** | (2006.01) |
| ***A47L 11/28*** | (2006.01) |
| *A47L 11/40* | (2006.01) |

(52) U.S. Cl.

CPC ..... *A47L 11/28* (2013.01); *A47L 11/00* (2013.01); *A47L 11/4072* (2013.01); *A47L 11/4061* (2013.01); *A47L 11/4066* (2013.01)

USPC ..... 15/340.1; 15/320

(58) Field of Classification Search

CPC ..... E01H 1/08; A47L 11/00; A47L 11/4066; A47L 11/4072

USPC ..... 15/340.1–340.4, 320

IPC ..... A47L 11/00; E01H 1/08

See application file for complete search history.

(56) References Cited

U.S. PATENT DOCUMENTS

| | | | |
|---|---|---|---|
| 4,010,507 | A | 3/1977 | Johnson |
| 5,044,043 | A | 9/1991 | Basham et al. |

(Continued)

FOREIGN PATENT DOCUMENTS

| | | |
|---|---|---|
| EP | 0867331 | 9/1998 |
| EP | 0788761 | 5/2000 |

(Continued)

OTHER PUBLICATIONS

EP04012451.3 Search Report dated Nov. 2, 2004.

(Continued)

*Primary Examiner* — David Redding

(74) *Attorney, Agent, or Firm* — Michael Best & Friedrich LLP

(57) ABSTRACT

A floor cleaning machine includes a cleaning system, a drive mechanism, and at least one steerable front wheel driven by the drive mechanism. The floor cleaning machine also includes two independently suspended rear wheels. A platform is located along a geometrical center axis between the two rear wheels. The platform is configured to support an operator of the floor cleaning machine in a standing position. A maximum vertical distance between the platform and the floor is 200 millimeters.

20 Claims, 3 Drawing Sheets

(56) References Cited

U.S. PATENT DOCUMENTS

| | | | | |
|---|---|---|---|---|
| 5,507,138 | A | 4/1996 | Wright et al. | |
| 5,785,453 | A | 7/1998 | Marty et al. | |
| 6,145,855 | A | 11/2000 | Bellis, Jr. | |
| 6,490,849 | B1 | 12/2002 | Scag et al. | |
| 6,497,422 | B1 | 12/2002 | Bellis, Jr. | |
| 8,234,748 | B2 | 8/2012 | Mayer | |
| 8,561,256 | B2 * | 10/2013 | Mayer | 15/340.1 |

FOREIGN PATENT DOCUMENTS

| | | |
|---|---|---|
| EP | 0951857 | 5/2010 |
| EP | 1262138 | 12/2012 |
| GB | 2338686 | 12/1999 |
| JP | 2-76594 | 6/1990 |
| JP | 5-5054 | 1/1993 |
| JP | 5-5056 | 1/1993 |
| JP | 11-280034 | 10/1999 |
| JP | 2003-029842 | 1/2003 |
| JP | 2003136977 | 5/2013 |

OTHER PUBLICATIONS

International Search Report and Written Opinion for Application No. PCT/US2005/015192 dated Jul. 26, 2005.

* cited by examiner

FLOOR CLEANING MACHINE

CROSS REFERENCE TO RELATED APPLICATIONS

This application is a continuation of U.S. patent application Ser. No. 13/477,846, filed May 22, 2012, which is a continuation of U.S. patent application Ser. No. 11/569,642, filed Oct. 16, 2008, which is a U.S. national phase application filing of International Patent Application No. PCT/US2005/015192, filed May 3, 2005, which claims the benefit of and priority to European Patent Application No. 04012451.3, filed May 26, 2004, the entire contents of each of which are incorporated herein by reference.

TECHNICAL FIELD

The present invention relates to a floor cleaning machine according to the preamble of claim 1.

BACKGROUND AND STATE OF THE ART

Various powered floor cleaning machines are known in the art, and they can be divided into the following two categories: in the first case, the operator is standing on the floor and walking behind the machine ("walk-behind" machines), in the second case, the operator is sitting on the machine itself ("ride-on" machines). Both systems have advantages and drawbacks.

Having the advantage of being space-saving and flexible in handling, "walk-behind" machines like the ones disclosed, f.e., in EP 0 788 761 and 1 262 138 have the following drawbacks, though. Firstly, the cleaning speed is limited because the machine has to be moved by the operator, and due to the tiring of the operator, the cleaning speed will be even further reduced during the cleaning process. Furthermore, the operator walks behind the machine and thus has only limited or no view on the working area. As a consequence, the cleaning of edges and a precise steering is difficult—this can be the cause for damages on the machine as well as on the furnishing. Furthermore, the guiding and steering of the whole machine must be performed by handcraft. However, due to the rotating cleaning members, the machine tends to deflect from the desired moving direction which imposes additional problems on the manual steering—EP 0 788 761 addresses this problem. Finally, a backwards approach to walls for picking up cleaning solution and dirt is difficult if not impossible.

"Ride-on" machines like the one disclosed, f.e., in EP 0 951 857 eliminate the above mentioned drawbacks of "walk-behind" machines at the price of other drawbacks. Firstly, in contrast to "walk-behind" machines, "ride-on" machines are very space-consuming because they have to be large enough such that the operator can sit on them on a driver's seat. Furthermore, it is very uncomfortable for the operator to jump on and off the machine to get things out of the way or pick up debris etc. Finally, in distinct areas, the operator has to simultaneously control two directions: the front for driving and the side for cleaning in the vicinity of edges.

U.S. Pat. No. 5,507,138 describes a lawn mowing machine where the operator is standing on the machine on a platform which is located between the rear wheels. However, due to the fact that this machine is not directed at cleaning a floor but cutting lawn and is, thus, used on rough ground which can also include steep hills, the platform is located as close to the ground as possible. Furthermore, the machine is equipped with wheels profiled for outdoor use as well as a heavy combustion engine for the cutter which can deal with these rough outdoor conditions. Each of the rear wheels is driven by a hydrostatic motor which is in communication with a hydrostatic pump. In operation, when the cutter engine is running, hydraulic fluid is delivered to each of the wheel motors, wherein the driving direction of the motors depends on the fluid direction, i.e., on the fluid path through corresponding conduits. In this way, the operator can cause the rear drive wheels to either both be driven in the forward/rearward direction or one be driven in the forward direction with the other being driven in the rearward direction. However, due to the above mentioned construction of the hydrostatic motors, the operator has to pre-select the moving direction of each motor—this results in a considerable rumbling when changing the driving direction of a motor. Thus, this kind of drive is not suitable for indoor use, and in particular not for cleaning purposes. In general there are no considerations regarding light weight and high mobility on a flat ground.

SUMMARY OF THE INVENTION

It is thus an object of the present invention to provide a floor cleaning machine which combines the advantages of "ride-on" and "walk-behind" systems without being subject to their problems and which takes into account the special requirements for indoor floor cleaning machines such as light weight, high mobility etc.

This is achieved by a floor cleaning machine with the features as described in claim 1. The present invention discloses an apparatus which uses the "ride-on" machines' feature that the operator is placed on the machine in order to enhance the cleaning speed and permit a backward movement. Since, according to the present invention, the operator is standing on the machine at a certain height—instead of sitting on it as in conventional "ride-on" machines—he has a better view on the working area and the whole machine is considerably smaller and more versatile than prior art "ride-on" machines.

According to the present invention, the floor cleaning machine comprises a cleaning system, at least one front wheel as well as two rear wheels and a drive mechanism, wherein the drive mechanism is an electric mono wheel drive and wherein the operator is placed on the machine, characterized in that the operator is standing on a platform which is located along the geometrical centre axis between the two rear wheels, wherein the maximum vertical distance between the platform and the floor is 200 mm.

DESCRIPTION OF THE PREFERRED EMBODIMENTS

Figure 1:
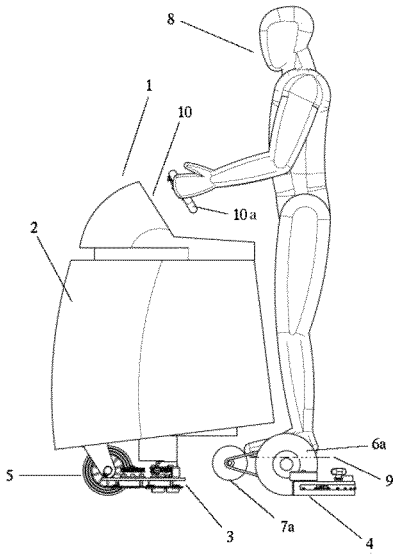
FIG. 1 shows a side view of the floor cleaning machine according to a first embodiment of the present invention with a front castor wheel and two independently driven rear wheels.
Figure 2:
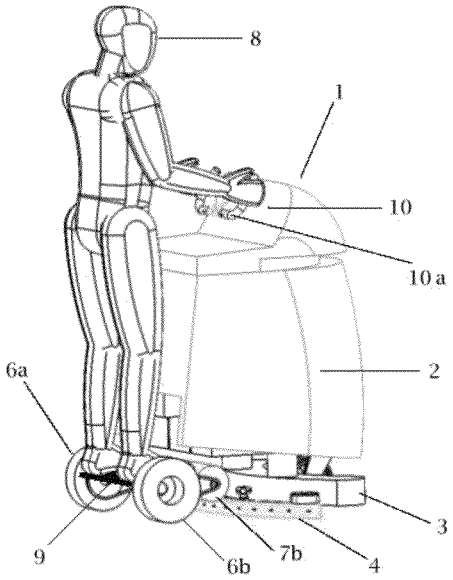
FIG. 2 shows a perspective rear view of the machine of FIG. 1, but with the squeegee located in front of the rear wheels.
Figure 3:
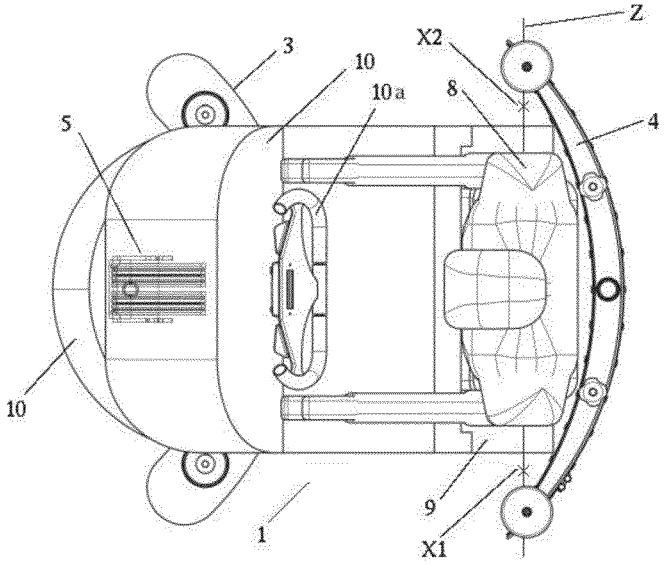
FIG. 3 shows a schematical top view of the machine of FIG. 1.

FIGS. 1, 2 and 3 illustrate the construction of the floor cleaning machine according to a first embodiment of the present invention. The cleaning system of the floor cleaning machine 1 comprises a tank 2, a brush unit 3 and a suction foot (squeegee) 4 behind the brush unit. The machine runs on a front castor wheel 5 and two powered rear wheels 6*a* and 6*b* which are independently driven by two drive motors 7*a* and 7*b*, resp. It is noted that the squeegee 4 can be located behind the rear wheels 6*a* and 6*b* (FIG. 1) as well as in front of them (FIG. 2)—the different locations do neither affect the cleaning results nor the movability/moving behaviour of the machine. Thus, in order to give a better view on the rear side of the machine, in FIG. 2 the squeegee 4 is shown in front of the rear wheels 6*a*, 6*b*. The wheels 6*a*, 6*b* are connected to their respective motors 7*a*, 7*b* by a belt or a chain, but other connections can also be used, f.e., hub motors. An operator 8 is standing on a platform 9 behind the tank and handles the machine via a user interface (dashboard) 10.

The machine is steered by influencing the drive speed of the rear wheels 6*a*, 6*b* via steering means 10*a*. Since the motors used are electric motors, the rear wheels 6*a*, 6*b* are steered in the following way. Steering means 10*a* has the form of a conventional steering wheel and the steering angle which is chosen by the operator by simply turning steering wheel 10*a* is converted by a processing unit (not shown) into corresponding relative rotation speeds for the electric motors 7*a*, 7*b*. Thus, rear wheels 6*a*, 6*b* are driven in a certain direction at certain relative speeds—depending on the position of steering wheel 10*a*. In this way, not only the turning radius of the machine is continuously variable but also a continuous—i.e., stepless—change of the driving directions of the wheels is possible without having to pre-select the driving direction. Instead of having the form of a steering wheel, steering means 10*a* can also have other designs. For example, it can consist of two hand gears or levers, one for each wheel, which are pulled forward or backward etc.

As is clear from FIGS. 1 and 2, according to the present invention, the operator is standing on the machine—instead of sitting on it as in conventional "ride-on" machines. However, depending on such conditions as the arrangement of the wheels, the way these wheels are steered and driven and the moving/turning speed of the machine, the operator can be subjected to considerable forces, for example, centrifugal forces. In contrast to conventional "ride-on" machines, these forces are of crucial importance to the present case because the operator is no longer sitting on the machine and becomes subjected to these forces having to balance them while he is standing freely on platform 9. Since floor cleaning machines move indoors on flat surfaces, often at considerable speeds and with very small turning circles, these centrifugal forces can be very high. Thus, in order to put the new feature of the operator standing on the floor cleaning machine into practice, considerations concerning the exact horizontal and vertical location of platform 9 are crucial. For example, the closer the platform is located to the actual centre of rotation, the smaller are the centrifugal forces the freely standing operator is subjected to.

Concerning the horizontal position of the platform 9, FIG. 3 helps to illustrate how the best location for platform on the floor cleaning machine can be found. In this embodiment, the floor cleaning machine is running on a front castor wheel 5 and two powered rear wheels 6*a* and 6*b* which are independently driven by two drive motors 7*a* and 7*b*, resp. As mentioned above, these motors are electric motors which can also be driven in the reverse direction. Thus, when being steered during operation, the floor cleaning machine is generally turned around a centre of rotation which is located on the geometrical centre axis Z through the two wheels 6*a* and 6*b*. Due to the variable driving speed relation between the two wheels, it is clear that the centre of rotation is not a fixed point but it can be located on any point on the geometrical centre axis Z. Several special cases can serve to illustrate this fact. The standard case will be a forward movement of the machine with a speed difference between the wheels 6*a* and 6*b*. For example, if both wheels are driven for a forward movement of the machine, but the left wheel 6*a* is driven at a higher speed than the right wheel 6*b*, the machine will move forwardly following an arcuate path with the centre of rotation X2. Analogously, if the driving speed of the right wheel 6*b* is higher, X1 will be the centre of rotation. Of course, the higher the speed difference between the two wheels, the closer the respective centre of rotation X1 or X2 will move inside along the axis Z towards one of the wheels. In the limiting case, i.e., when the driving speed of one of the drive wheels 6*a* or 6*b* becomes zero, drive wheel 6*a* or 6*b* itself becomes the centre of rotation. For example, when the drive speed of the left drive wheel 6*a* is zero and the drive speed of the right drive wheel 6*b* is larger than zero, the centre of rotation X1 will conicide with wheel 6*a*, i.e., the machine will turn around drive wheel 6*a*. Analogously, when the drive speed of wheel 6*b* is zero, the centre of rotation X2 will conicide with wheel 6*b*, i.e., the machine will turn around drive wheel 6*b*. But the centre of rotation can even be further shifted to a point on the axis Z between the two wheels 6*a* and 6*b*. This can achieved by driving the two wheels in opposite directions, i.e., one wheel for a forward movement of the machine and the other for a backward movement of the machine. For example, if wheel 6*a* is driven for a forward movement and wheel 6*b* for a backward movement, but with a slower speed than wheel 6*a*, the centre of rotation will be located on the axis Z between the middle and wheel 6*b*. Analogously, if the speed of wheel 6*b* is higher, the centre of rotation will be located on the axis Z between the middle and wheel 6*a*. In the limiting case, when the driving speeds of the wheels 6*a* and 6*b* have the same value but are directed in opposite directions, the centre of rotation will coincide with the middle of the axis Z. It is clear from the above that these ways of driving the machine—and the considerable centrifugal forces resulting therefrom—only hold for machines which have mono wheel drives such as floor cleaning machines.

With these considerations in mind, the horizontal location of platform 9 can now be found as follows. Since all possible centres of rotation on the axis Z have to be taken into account when calculating the optimal location of the platform, a compromise has to be found. For example, if the actual centre of rotation is X1, it does not matter how far X1 lies outside the machine: in any case, the optimal location of platform 9—taking into account the centrifugal forces—would be at drive wheel 6*a*. Analogously, in case X2 is the actual rotation centre, the optimal location of the platform would be at drive wheel 6*b*. Of course, the same applies if the centre of rotation coincides with one of the respective wheels. Since both rotation cases can occur during operation of the floor cleaning machine, the best compromise for the horizontal location of platform 9 is the centre point of the geometrical centre axis Z between the two drive wheels 6*a* and 6*b*.

The cases where the centre of rotation is even located on a point on the geometrical axis between the wheels 6 and 6*b* further support this choice.

Having found the horizontal position for the platform 9 on the machine, considerations concerning the vertical position of the platform, i.e., its height above the floor, must also be taken into account. Since the rear wheels 6*a*, 6*b* are driven independently, they are also suspended independently and there is no physical axis corresponding to the geometrical axis Z between the rear wheels. Thus, the downward limitation for the platform 9 is not a physical axis between the wheels but in fact the floor itself, such that the limitating factor is a reasonable ground clearance which is in the order of 40 mm. It should be noted that these considerations hold for all embodiments where the rear wheels are independently suspended. Regarding the other limit of the vertical position of the platform, i.e., its maximum height above the floor, one has to take into account several factors. Generally, it should be noted that the possibility of a continuous, i.e., stepless, change of the driving directions of the drive wheels, as mentioned above, supports a higher location of platform 9 because no rumbling occurs. Among the limiting factors are, firstly, that increasing the height of the platform also raises the centre of gravity which in turn results in a reduced stability of the machine. Secondly, the higher the platform, the more bumps on the floor will be amplified—until the operator's intuitive confidence in the security of the machine will be disturbed in an unacceptable way. Extensive experiments have shown that the height of the platform 9 above the floor should not exceed 200 mm. It should be noted that this result takes into account the special conditions which apply to the floors to be cleaned, for example, large and generally flat floors in supermarkets and the like with the typical residues thereon. Due to the above mentioned factors delimiting the maximum height of the platform, these considerations hold for all embodiments of the floor treatment machine.

Figure 4:
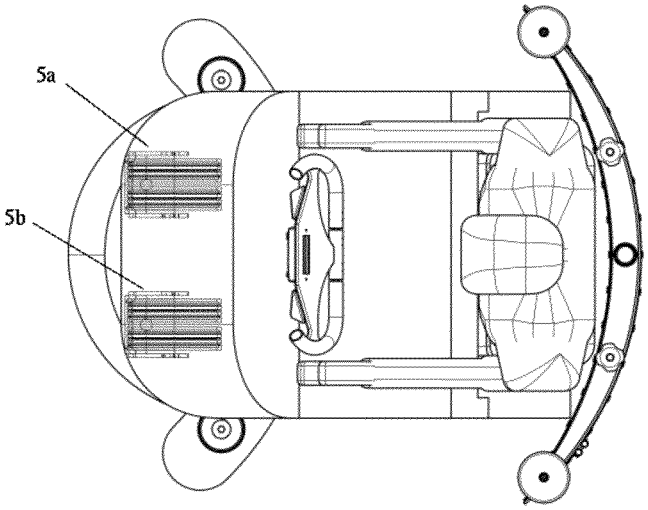
FIG. 4 shows a schematical top view of the floor cleaning machine according to second embodiment of the present invention with two independent front castor wheels and two independently driven rear wheels.

In FIG. 4, a second embodiment is shown, wherein the one castor wheel is replaced by two independent castor wheels 5*a* and 5*b* the distance between which is smaller than the distance between the two independently powered rear wheels 6*a* and 6*b*. Due to the same drive of the two rear wheels as in the first embodiment, he moving bevaviour of the machine will be the same—depending on the relative driving speed of drive wheels 6*a* and 6*b*. Thus, the same considerations concerning the location of platform 9 for the operator apply.

Figure 5:
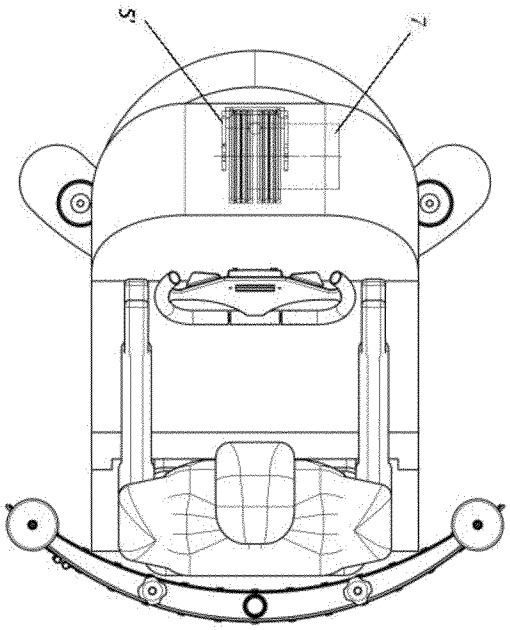
FIG. 5 shows a schematical top view of the floor cleaning machine according to a third embodiment of the present invention with a steered and driven front wheel and two independently suspended rear wheels.

In FIG. 5, a third embodiment is shown, wherein front wheel 5' is steered and powered by a drive 7, and the rear wheels 6*a'* and 6*b'* (not shown) are independently suspended but not driven. Since a reverse drive of the two rear wheels 6*a'* and 6*b'* is missing in this embodiment, the floor cleaning machine is either turned around the centre of rotation X1 or around the centre of rotation X2. Thus, the same considerations concerning the location of platform 9 for the operator apply.

As can easily be seen from the above description, due to its feature of the operator standing on a platform on the machine, the floor cleaning machine according to the present invention leads to enhanced cleaning speed and permits a backward movement. Since the operator is standing on the machine—instead of sitting on it—he has a better view on the working area and the whole machine is considerably smaller and more versatile than prior art "ride-on" machines. The operator's view on the working area can be enhanced by raising platform up to the upper limit.

It is emphasized that the different embodiments of the present invention as mentioned above describe the invention by way of example only. Various alternatives are also in the scope of the present invention as defined in the appended claims. For example, the arrangement of the cleaning means can be modified, i.e., the brush unit could also be positioned in front of the front wheel and the squeegee could be positioned in front of the rear wheels.

The invention claimed is:

1. A floor cleaning machine comprising:
- a cleaning system;
- a drive mechanism;
- at least one steerable front wheel driven by the drive mechanism;
- two independently suspended rear wheels; and
- a platform located along a geometrical center axis between the two rear wheels,
- wherein the platform is configured to support an operator of the floor cleaning machine in a standing position, and
- wherein a maximum vertical distance between the platform and the floor is 200 millimeters.

2. The floor cleaning machine of claim 1, wherein the two rear wheels are rotatable in response to the front wheel being driven.

3. A method of operating a floor cleaning machine, the method comprising:
- supporting the floor cleaning machine on at least one front wheel and two independently suspended rear wheels;
- positioning an operator of the floor cleaning machine in a standing position on a platform located along a geometrical center axis between the two rear wheels and at a height no greater than 200 millimeters above the floor; and
- driving the two rear wheels with a drive mechanism.

4. The method of claim 3, wherein the two rear wheels are independently driven by two drive motors.

5. The method of claim 3, wherein the platform is located at a center point of the geometrical center axis between the two rear wheels to minimize a centrifugal force experienced by the operator during operation of the floor cleaning machine.

6. A floor cleaning machine comprising:
- a cleaning system comprising at least one squeegee;
- an electric drive mechanism;
- at least one steerable front wheel driven by the electric drive mechanism;
- two rear wheels; and
- a platform located along a geometrical center axis between the two rear wheels,
- wherein the platform is configured to support an operator of the floor cleaning machine in a standing position, and
- wherein a maximum vertical distance between the platform and the floor is 200 millimeters.

7. The floor cleaning machine of claim 6, wherein the cleaning system further comprises a brush unit.

8. The floor cleaning machine of claim 7, wherein the brush unit is located in front of the at least one steerable front wheel.

9. The floor cleaning machine of claim 7, wherein the at least one squeegee is located behind the brush unit.

10. The floor cleaning machine of claim 6, wherein the at least one squeegee is located behind the two rear wheels.

11. The floor cleaning machine of claim 6, wherein the at least one squeegee is located in front of the two rear wheels.

12. The floor cleaning machine of claim 6, wherein the two rear wheels are independently suspended.

13. The floor cleaning machine of claim 6, wherein the platform is located above the geometrical center axis between the two rear wheels.

14. The floor cleaning machine of claim 6, wherein the platform is positioned to support a user in a standing position between the two rear wheels.

15. The floor cleaning machine of claim 6, wherein the electric drive mechanism is reversible.

16. The floor cleaning machine of claim 15, wherein the electric drive mechanism comprises an electric mono wheel drive.

17. The floor cleaning machine of claim 6, wherein the electric drive mechanism comprises an electric mono wheel drive.

18. The floor cleaning machine of claim 6, wherein the two rear wheels are unpowered.

19. The floor cleaning machine of claim 18, wherein the two rear wheels are independently suspended.

20. The floor cleaning machine of claim 6, wherein a minimum vertical distance between the platform and the floor is 40 mm.

* * * * *